US006206059B1

(12) United States Patent
Maakad et al.

(10) Patent No.: US 6,206,059 B1
(45) Date of Patent: Mar. 27, 2001

(54) SKIRT LIFTING APPARATUS AND METHOD

(76) Inventors: Guy Maakad, 6982 Hannegan Rd.; Richard TerWisscha, 7467 Hannegan Rd., both of Lynden, WA (US) 98264

( * ) Notice: Subject to any disclaimer, the term of this patent is extended or adjusted under 35 U.S.C. 154(b) by 0 days.

(21) Appl. No.: 09/461,694

(22) Filed: Dec. 14, 1999

Related U.S. Application Data

(60) Provisional application No. 60/139,040, filed on Jun. 10, 1999, and provisional application No. 60/125,202, filed on Mar. 18, 1999.

(51) Int. Cl.[7] ..... B65B 1/04

(52) U.S. Cl. ..... 141/346; 141/383; 141/385

(58) Field of Search ..... 141/346, 363, 141/364, 365, 367, 368, 383, 384, 385, 386; 414/216, 328, 293, 292, 294, 299; 406/113, 115, 116, 133, 167; 193/4, 6, 25 C, 30; 198/575, 536, 550.2; 202/227, 224, 262

(56) References Cited

U.S. PATENT DOCUMENTS 4,875,555 * 10/1989 Johansson et al. .
5,098,524 * 3/1992 Antalfy et al. ..... 202/96
5,139,110 * 8/1992 Kishi ..... 187/244
5,144,992 * 9/1992 Jaerger et al. ..... 141/346
5,628,603 * 5/1997 Antalffy et al. ..... 414/216
6,039,844 * 3/2000 Malik ..... 202/227

* cited by examiner

*Primary Examiner*—Steven O. Douglas
*Assistant Examiner*—Khoa Huynh
(74) *Attorney, Agent, or Firm*—Hughes & Schacht, P.S.; Robert B. Hughes

(57) ABSTRACT

An automated low clearance skirt assembly lifting device adapted for raising and lowering a circular or multifaceted skirt to match the opening of pressure vessels such as coking drums and a method for uniform remote operation of the assembly. The low clearance skirt lifting assembly includes a reinforcement of the upper skirt attached to one or more lifting cylinders mounted within a telescoping enclosure, so that the skirt assembly may be uniformly extended and retraced without binding or side load transfer to the hydraulically or pneumatically actuated device. Following the unheading of the flange on the coke drum, the skirt is remotely extended to align with the flange hereby bridging the gap between the chute and the drum prior to commencement of the drilling cycle and lowered once all the coke has been extracted from the drum.

15 Claims, 13 Drawing Sheets

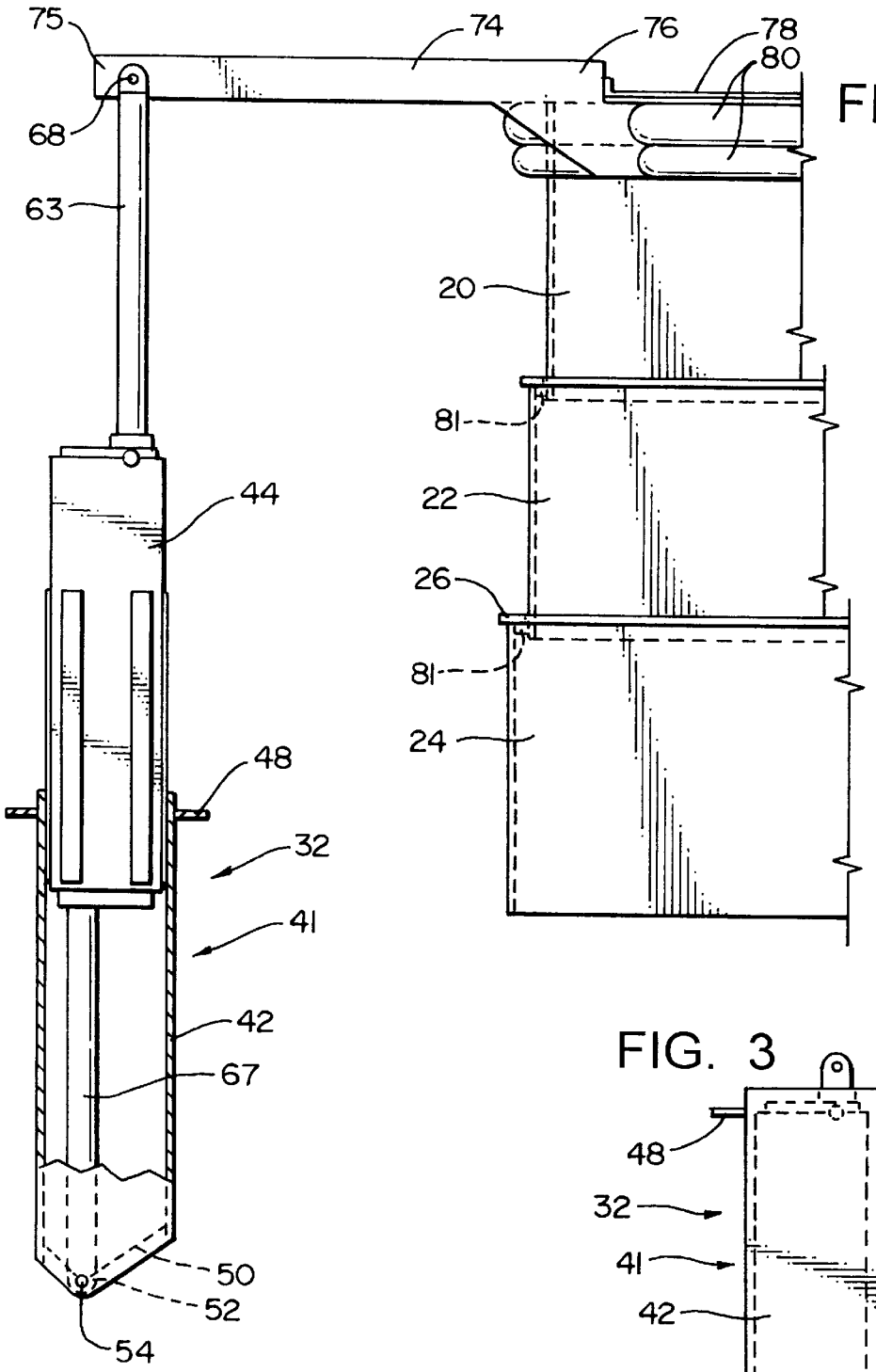
FIG. 4
FIG. 3
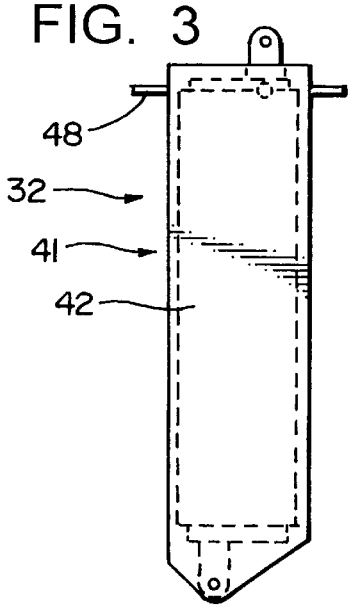

SKIRT LIFTING APPARATUS AND METHOD

This application claims benefit of Provisional Application Ser. No. 60/139,040 filed Jun. 10, 1999 and Ser. No. 60/125,202 filed Mar. 18, 1999.

BACKGROUND OF THE INVENTION

A) Field of the Invention

This present invention relates to an apparatus and method for moving coke from a drum, commonly used in the petroleum industry, and directing this coke into a chute. More specifically this invention pertains to an automated low clearance skirt lifting assembly for vertical vessels such as coke drums. It pertains particularly to an automated extendible assembly used in combination with one or more hydraulically or pneumatically actuated members situated within a telescoping assembly.

B) Background Art

During operation of delayed coking drums for the coking of various heavy hydrocarbon materials in petroleum refining operations, the resulting coke is deposited progressively in the inner walls of the drum and when full, must be periodically removed, usually at 24 hour intervals. A typical apparatus for such coking drums is disclosed by U.S. Pat. No. 4,611,613 to Kaplan. Such coke removal from coking drums is accomplished through an opening in the lower end of a vertically oriented drum, after the bottom head is removed, the skirt is typically raised manually by means of hoisting equipment or automatically by means of single stage hydraulic cylinders. However, because coking drums operate at elevated temperatures, 800–900° F., personnel hazards exist due to exposure of fallout of coke once the head cover is removed. The manual means is hazardous and undesirable. The hydraulically activated means is preferred. However, existing low clearance skirts retrofitted with telescoping cylinders with space limitations have not operated successfully due to volume differential inherent to conventional telescoping cylinders. Single acting cylinders have operated for short periods of time in high clearance applications, but have experienced excessive seal fatigue due to side loading and exposure to the coke dust and corrosive environment. While the prior skirt devices have been found to have serious deficiencies when applied to raising the skirts of coke drums. Such deficiencies have now been advantageously overcome by the present invention.

SUMMARY OF THE INVENTION

This invention provides an automated skirt lifting device assembly, which is adapted to the remote raising and lowering of skirts on a vertically oriented vessel such as a coking drum. The invention includes a circular or multifaceted connector unit which is attached to the upper portion of the skirt, and one or more extendible enclosures, with internally mounted extendible devices that are hydraulically or pneumatically activated.

In one embodiment, for the low clearance application, the extendible device consists of a plurality of short stroke devices mounted with opposing strokes, essentially more than doubling the extension range over the required envelope in the collapsed mode while maintaining staging of the one or more devices due to the commonality of actuating parts and associated surface areas. In the case of the two or more actuating devices, this invention provides a method for equally delivering the actuating force to all units to insure uniform simultaneous extension or retraction of the device.

Desirably the skirt device consists of a tubular or multifaceted reinforcement attached to the top edge of the coker skirt with one or more circular, or multifaceted extendible pair of hollow tubes enclosing a low clearance opposedly acting Siamese cylinder. This device is capable of an extended length that is more than double its collapsed length. The inner tube is slidably-mounted within the outer tube and is attached by means of an arm extension to the skirt reinforcement. The outer tube is firmly mounted to the deck or chute structure. The inner tube is slide activated with respect to the outer tube either hydraulically or pneumatically.

In one preferred embodiment, the hydraulic system employs the use of two or more conventional hydraulic cylinders joined together at the cylinder body in a Siamese fashion with opposed acting extendible rods attached to identical pistons mounted within the identical bore of each cylinder. Hydraulic oil is provided to all cylinders by means of the lower extension rod which is hollow and encompasses two hydraulic tubes and is bored with two inlet ports and respective oil galleries. This methodology permits the raising of the cylinder barrel without moving the hydraulic line from the metering device. The flow is metered in both the supply and return lines by means of a flow divider which insures simultaneous and equal extension or retraction of each cylinder; thereby eliminating binding of the skirt which is inherent to the use of conventional telescoping cylinders. Also this can be a pneumatic system, using air or steam.

To describe the invention in other terms, the skirt section has an upper inlet end which is movable from a lower retracted position to an upper engaged position to receive the coke from the coking drum. There is a plurality of fluid actuators arranged to be in operative engagement with the skirt to move the skirt between its retracted and engaged positions.

In one preferred embodiment, each of the actuators comprises first and second cylinder and piston units, having first and second cylinders, respectively, and first and second piston members, respectively, with each piston member comprising a piston and a piston rod. The first and second cylinders are positioned in side by side relationship and arranged so that the first piston member extends in a downward direction from its related cylinder, and the second piston member extends upwardly from its related second cylinder.

The lower end of the piston rod of the first piston member is connected to a lower base location, and an upper end of the piston rod of the second piston member is connected to the skirt section. Thus, when each of the fluid actuators are extended, an extension of the first piston member from the first cylinder causes the first and second cylinder members to move upwardly, and an extension of the second piston member from the second cylinder moves the upper end of the piston rod of the second piston member upwardly to move the skirt upwardly towards its upper engaged position.

In the hydraulic system of the embodiment described immediately above, there is a first fluid inlet/outlet at the lower end of the first piston rod and a passageway on the first piston rod leading from the first fluid inlet/outlet to a pressure region in an upper part of the first cylinder above the first piston. Thus, fluid from the first inlet/outlet travels upwardly through the passageway of the first piston rod to cause upward movement of the first and second cylinders.

Further, there is a first fluid outlet/inlet at the upper pressure region of the first cylinder, leading to a second pressure region in a lower part of the second cylinder and below the first piston in the second cylinder. The fluid flow through the first inlet/outlet causes fluid to flow upwardly through the passageway in the piston rod of the first piston member into the first piston pressure region, and thence into the second pressure region of the second cylinder so as to cause motion said first and second piston members to extend.

There is a second fluid outlet/inlet at a lower end of the piston rod of the first piston member through which fluid flows from the piston rod of the first piston member during extension of the first piston member. The piston rod of the first piston member has a fluid outflow passageway having an upper opening at the upper end of the first piston member to receive an outflow of fluid from an annular region between the piston rod of the first piston member and the first cylinder.

There is a third fluid inlet/outlet at the lower end of the first cylinder which communicates with the annular region between the first cylinder and the piston rod of the first piston member to receive fluid flow from an annular region that is between the piston rod of the second piston member and the second cylinder. When the first and second pistons are moving toward an extended position, fluid flow from the annular region within the second cylinder flows to the annular region of the first cylinder, thence into the upper opening to the second passageway in the piston rod of the first piston member to flow outwardly through the second outlet/inlet leading from the lower end of the first piston member.

In a preferred form, the first passageway of the piston rod of the first piston member comprises a tubular member positioned within the piston rod. The second return passageway in the piston rod of the first piston member comprises an annular passageway defined by a surrounding tubular wall of the piston rod of the first piston member and the tubular member that defines the first passageway in the first piston member.

Also in the preferred form, there is for each actuator a telescoping load bearing structure comprising at least first and second load bearing sections located at least partially around the actuator. The first and second load bearing sections have a retracted position when the actuators are in the retracted position and an extended position when the actuators are in the extended position. The first load bearing member engages a base location so as to transfer loads from the first bearing structure to the base location. The second load bearing member operably engages an extending portion of the actuator in a manner to receive torsional and/or lateral loads and transmit these to the first load bearing member to alleviate such lateral and/or torsional loads being imposed solely on the actuators.

In the embodiment where there are first and second cylinder and piston units, one section of the load bearing member is positioned at the location of the first and second cylinders, and the other section of the load bearing member is located at the piston of the first cylinder and piston unit. Further, the second load bearing section in the preferred form has an upper end thereof connected to the upper end of the first and second cylinders, and a lower end of the first load bearing member extends downward to a location at which the first end of the lower piston rod is located.

In the preferred form, the first and second load bearing sections have non-circular cross sectional configurations to prevent rotational movement relative to one another along a lengthwise axis. In the preferred form, the cross sectional configuration is a rectangular cross sectional configuration.

Further, the present invention comprises a locking system where there is at least one locking unit being mounted at a location proximate to an upper portion of the skirt when the skirt is in its upper engaged position. Further, there is a locking element connected to the skirt and being operable to move into a locking location when the skirt is in its upper engaged position.

The locking unit comprises a locking arm having a pivot location about which it rotates and an outer end location. The locking arm has a locking member which in a locking position engages a locking element and in a released position is spaced laterally from the locking element. The locking element is arranged so that as the skirt moves upwardly toward its engaged position, and the locking arm is at its lower locking location, the upward movement of the locking element causes movement of the locking arm away from its locking position, and further upward movement of the locking element permits downward movement of the locking arm to its locking position, with the locking member positioned in locking engagement with the locking element.

Desirably, the locking element is mounted to the locking arm in a manner that the locking element is moveable toward and away from the pivot mounting location of the locking arm. The locking member is further arranged so that a movement from its locking position toward its released position, the locking member moves to a hold release position to prevent the locking arm from moving to its locking location.

In a specific configuration, the locking arm comprises a pair of arm elements having elongate slots therein. The locking member is moveable back and forth within the slots. The locking unit comprises a mounting structure having a locating edge portion which engages the locking member as the locking arm is being moved from the locking to the released position, so as to move the locking member to its hold release position.

Also in this preferred configuration, the mounting structure comprises a pair of mounting plates, each having slots which engage the locking member. Thus, the slots in the arm members and the slots in the mounting structure program the movement of the locking member.

There is a second embodiment which is similar to the first embodiment, except that each actuator comprises only a single cylinder and piston assembly. The upper end of the piston rod attaches to the skirt and the lower end of the cylinder connects to a base location. Also, in the second embodiment, there is a telescoping load bearing structure comprising the first and second load bearing sections. The first load bearing section has a lower end portion adjacent to a lower end of the cylinder, and the second upper load bearing section has its upper end attached to the upper end of the piston rod.

Other features of the present invention will become apparent from the following detailed description.

BRIEF DESCRIPTION OF THE DRAWINGS

FIG. 3 is a longitudinal sectional view of one of the cylinder assemblies of their first embodiment in its retracted position, with the section line being taken along the vertical axis of the cylinder assembly;

FIG. 4 is a view similar to FIG. 3, but showing the cylinder assembly in its extended position, and also showing the skirt assembly in its retracted position.

DESCRIPTION OF PREFERRED EMBODIMENTS

Figure 1:
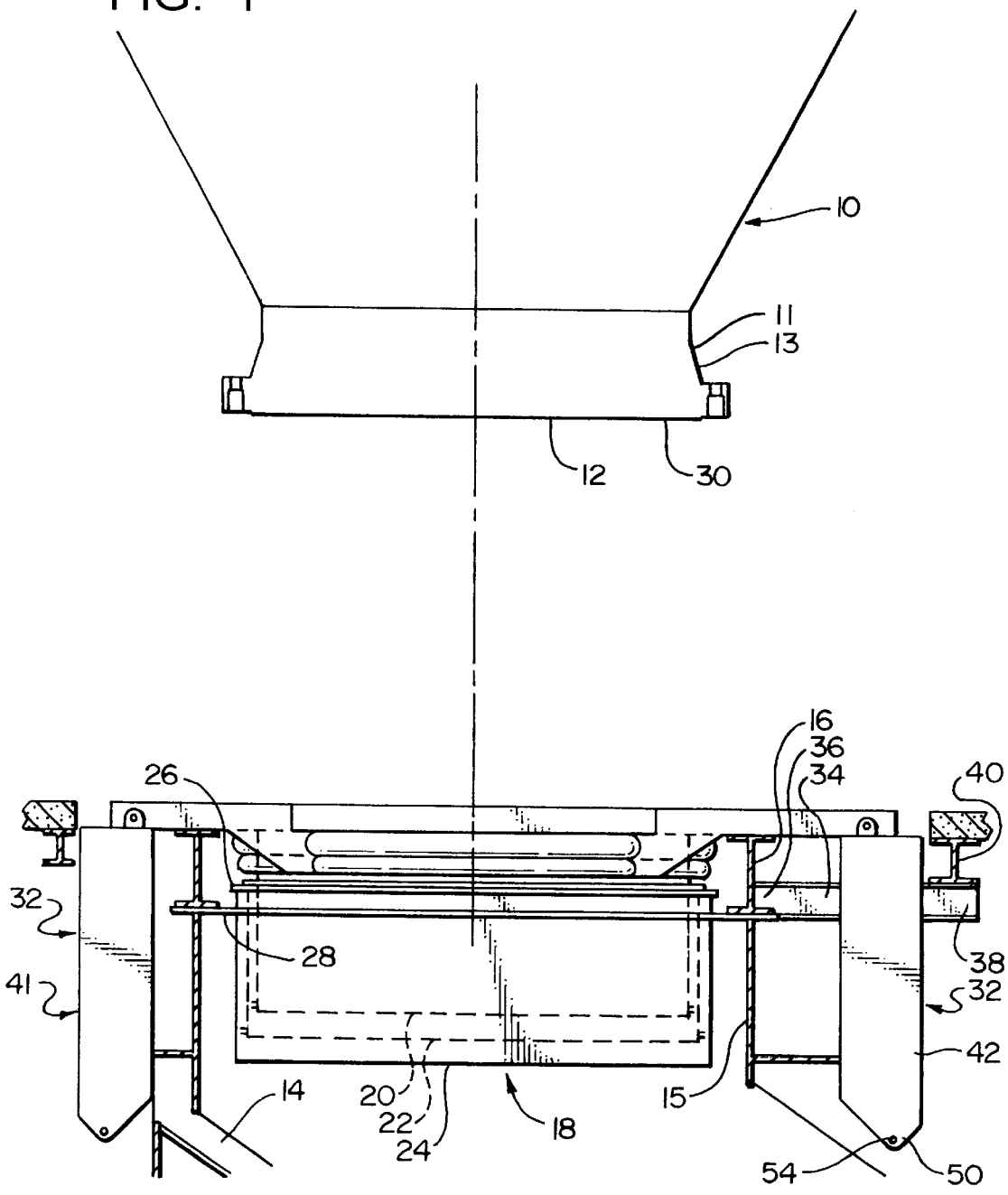
FIG. 1 is a longitudinal sectional view taken along the vertical center axis of the apparatus of a first embodiment of the present invention, showing the skirt in its retracted position.

With reference first to FIG. 1, there is shown a first embodiment of the present invention. There is a coking drum 10 which converges toward a downward location, and at the downward location of the drum 10 there is a discharge portion 11 having a generally cylindrical configuration and defining a cylindrical discharge opening 12. The discharge portion 11*a* comprises a body flange 13 which has a generally circular configuration, and through which the coke is discharged.

There is shown at the bottom of FIG. 1*a* lower chute 14, which comprises an upper entry cylindrical housing generally designated 15.

There are several I beams 16 as part of the fixed support structure, and there is also a skirt assembly 18 which is supported from the I beams 16. More particularly, this skirt assembly comprises three telescoping skirt components, namely an inner most skirt 20, and intermediate skirt 22 and an outer skirt 24. In other installations, there could be a single skirt which would be of somewhat longer length, or there could be two skirts or possibly more than three skirts.

The outer skirt 20 has an outwardly extending lip or flange 26 which rests upon a circumferential supporting flange or member 28. In operation, this skirt assembly 18, (or the single skirt if a single skirt is used) is lifted upwardly so that the upper edge of the skirt comes into contact with a downwardly facing surface or member 30 that is part of the discharge body flange 12.

Figure 2:
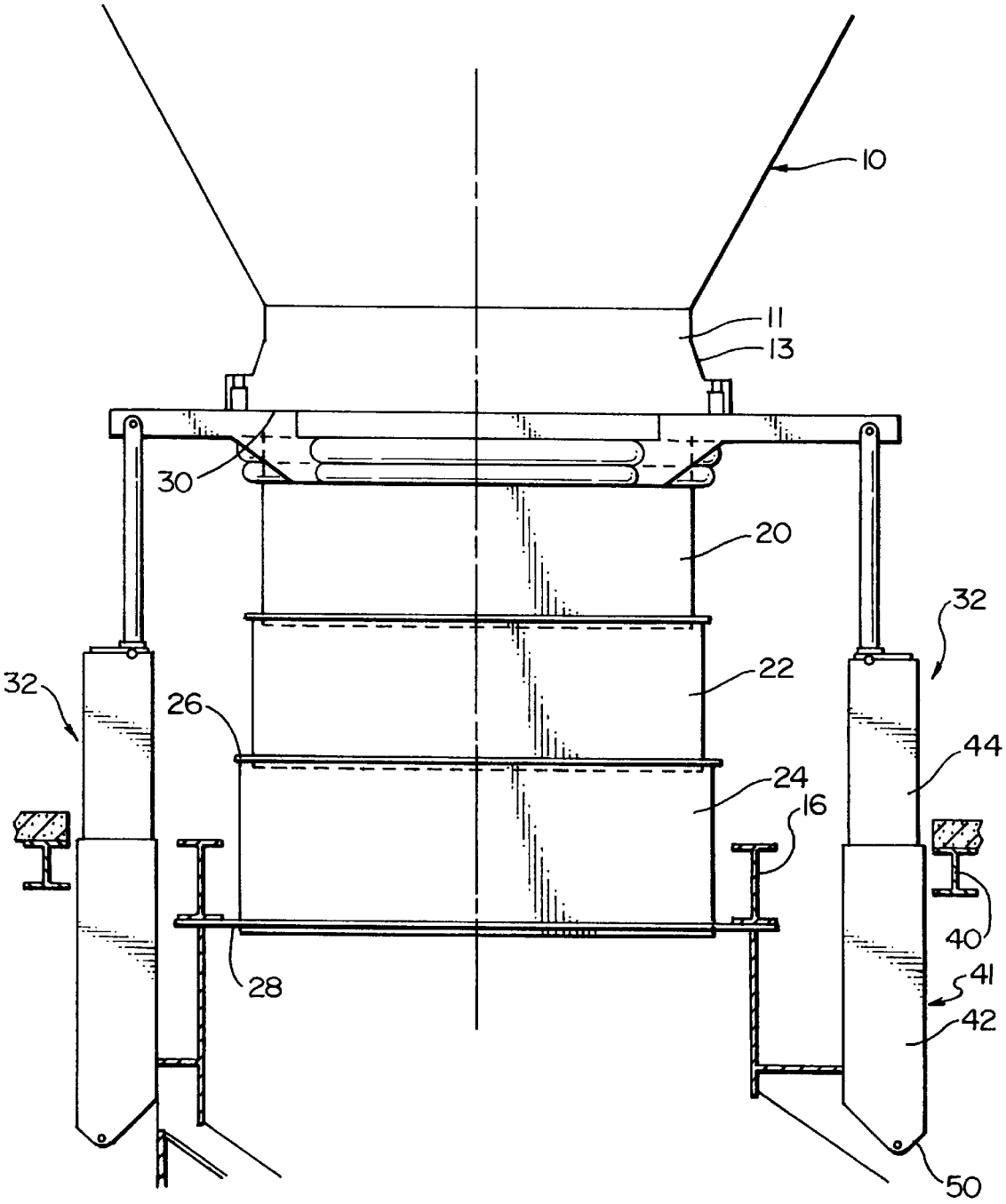
FIG. 2 is similar to FIG. 1, but showing the skirt in its extended position for discharging the coke downwardly through the skirt.

In order to move the skirt assembly 18 from its lower retracted position of FIG. 1 to its upper extended position of FIG. 2, there is provided a plurality of cylinder and piston assemblies 32. In this present configuration there are generally between two to four of these cylinder and piston assemblies 32. At this point, it should be noted that a significant part of the present invention is that each of the cylinder and piston assemblies 32 extends to its raised position of FIG. 2 in a manner that the rate of travel of the several cylinder and piston assemblies 32 is the same or within very close tolerances of one another so that the skirt assembly is moved evenly up to its engaged position as shown in FIG. 2. Also it's important that the skirt assembly 18 be retracted down to it's stowed position of FIG. 1 in a manner that the cylinders descend at the same rate so that the upper end of the skirt assembly 18 remains level.

In order to support the several cylinders 32 there are provided a number of support members 34 (see FIG. 1) which are connected at one location 36 to the beam 16 and at the opposite end 38 to another beam 40 which is part of stationary structure.

Attention is now directed to FIGS. 3 and 4. Each cylinder and piston assembly 32 comprises a tube assembly 41 comprising a fixed tube 42 and an extension tube 44, and also a cylinder and piston component 45 which is positioned within the tube assembly 41.

The fixed tube 42 has in transverse section a rectangular configuration, and the extension tube 44 has a rectangular cross section generally matching that of the fixed tube 42 so that the extension tube can fit within the fixed tube 42. In the particular arrangement shown herein, the extension tube 44 has a number of plastic slide plates or pads 46 which are closely adjacent to (but spaced a short distance from) the inner surfaces of the fixed tube 42.

The fixed tube 42 has fixedly attached thereto at its upper end a support flange 48 which in turn engages the related aforementioned support member 34 to provide support.

At the lower end of each fixed tube 42 there is a mounting structure 50 that has a trunion mount at 52 to support a horizontally extending pin member 54. As will described later herein, this pin member attaches to the lower end of the Siamese cylinder and piston component 56 which will be described further below.

Figure 5:
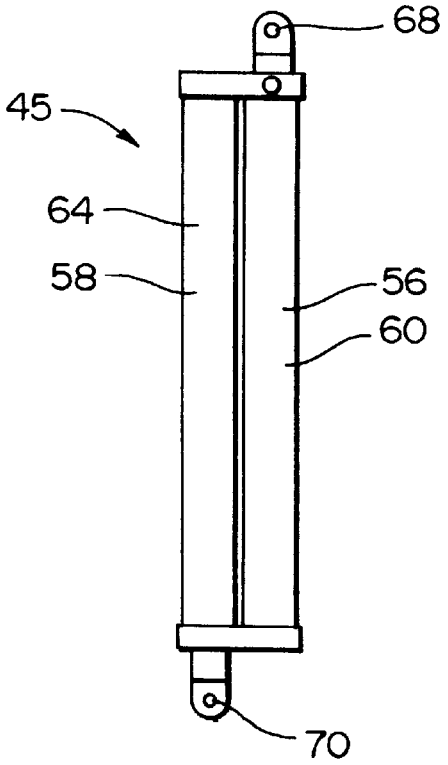
FIG. 5 is a view of a siamese cylinder and piston component which is part of the assembly shown in FIG. 3, in its retracted position.
Figure 6:
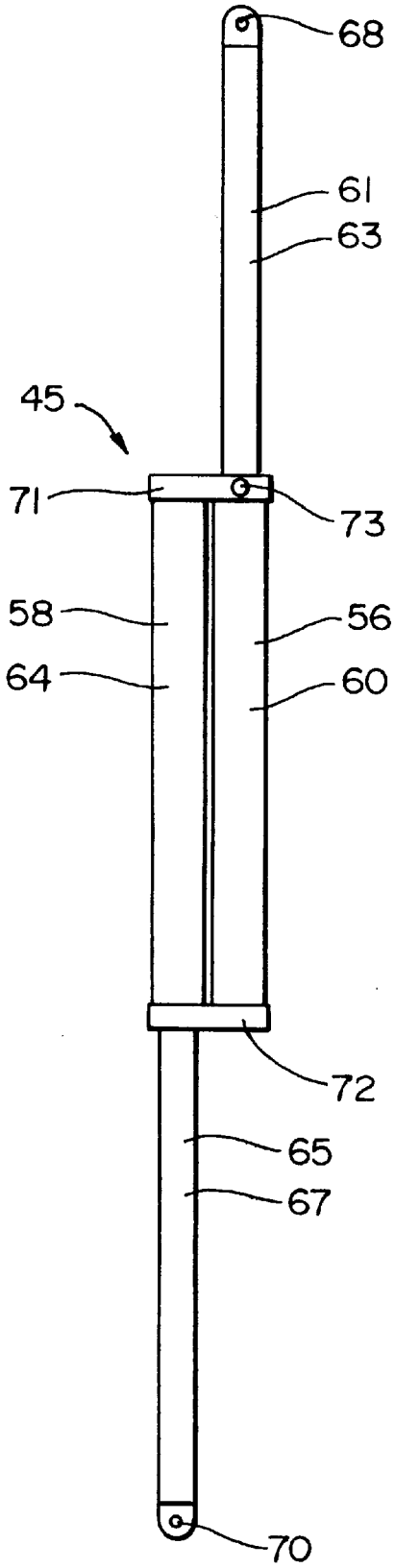
FIG. 6 is view similar to FIG. 5, but showing the cylinder and piston component in its extended position.

Attention is now directed to FIGS. 5 and 6 which illustrate the cylinder component 45. This cylinder component comprises two cylinder and piston units 56 and 58, respectively. The unit 56 comprises a cylinder 60 and a piston member 61 with a piston 62, and a piston rod 63, and in like manner the piston and cylinder unit 58 comprises a cylinder 64 and a piston member 65 with a piston rod 67. At the upper end of the rod 62, there is a rod eye with a spherical bearing designated as 68, and there is at the lower end of the rod 66 a similar spherical bearing 70. The two cylinders 60 and 64 are interconnected by an upper fitting 71 and a lower fitting 72 to fixedly hold these cylinders 58 and 60 to one another. The upper fitting has two pins 73 which have a trunnion connection to the extendible tube 44.

The lower connecting portion 70 connects directly to the aforementioned pin member 54. The upper connecting portion 68 of each piston rod 63 is connected to a support arm 74 having one end 75 connecting to the rod end connection 68 and the other end 76 fixedly connected to an upper edge 78 inner skirt component 20. The upper circumferential portion of the inner skirt 20 has a pair of reinforcing rings 80. Thus, as each of the piston components 45 are extended, each arm 74 is lifted to in turn lift the inner skirt 20. The skirt components 20, 22 and 24 are so arranged that as each skirt component 20,22, and 24 are raised, the edges 81 inter-engage to move these out to the extended positioned as shown in FIG. 2.

As indicated earlier, it is a significant feature of the present invention that these cylinder and piston assemblies 32 are extended and retracted in a controlled manner to maintain the skirt assembly 18 close to a horizontal position. This will be described with reference to FIG. 7.

Figure 7:
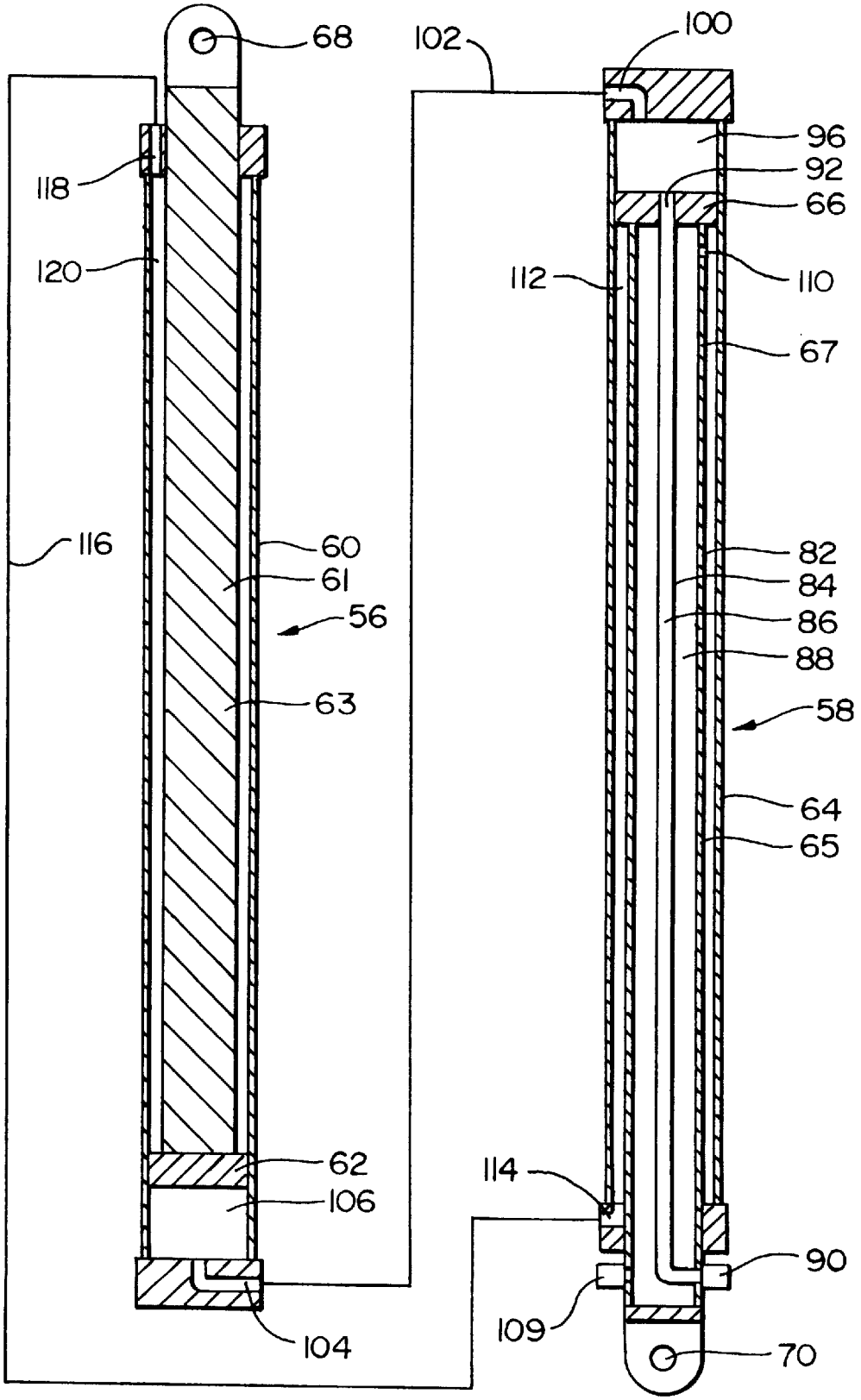
FIG. 7 is a schematic view illustrating the hydraulic system for each of the cylinder and piston assemblies.
Figure 8:
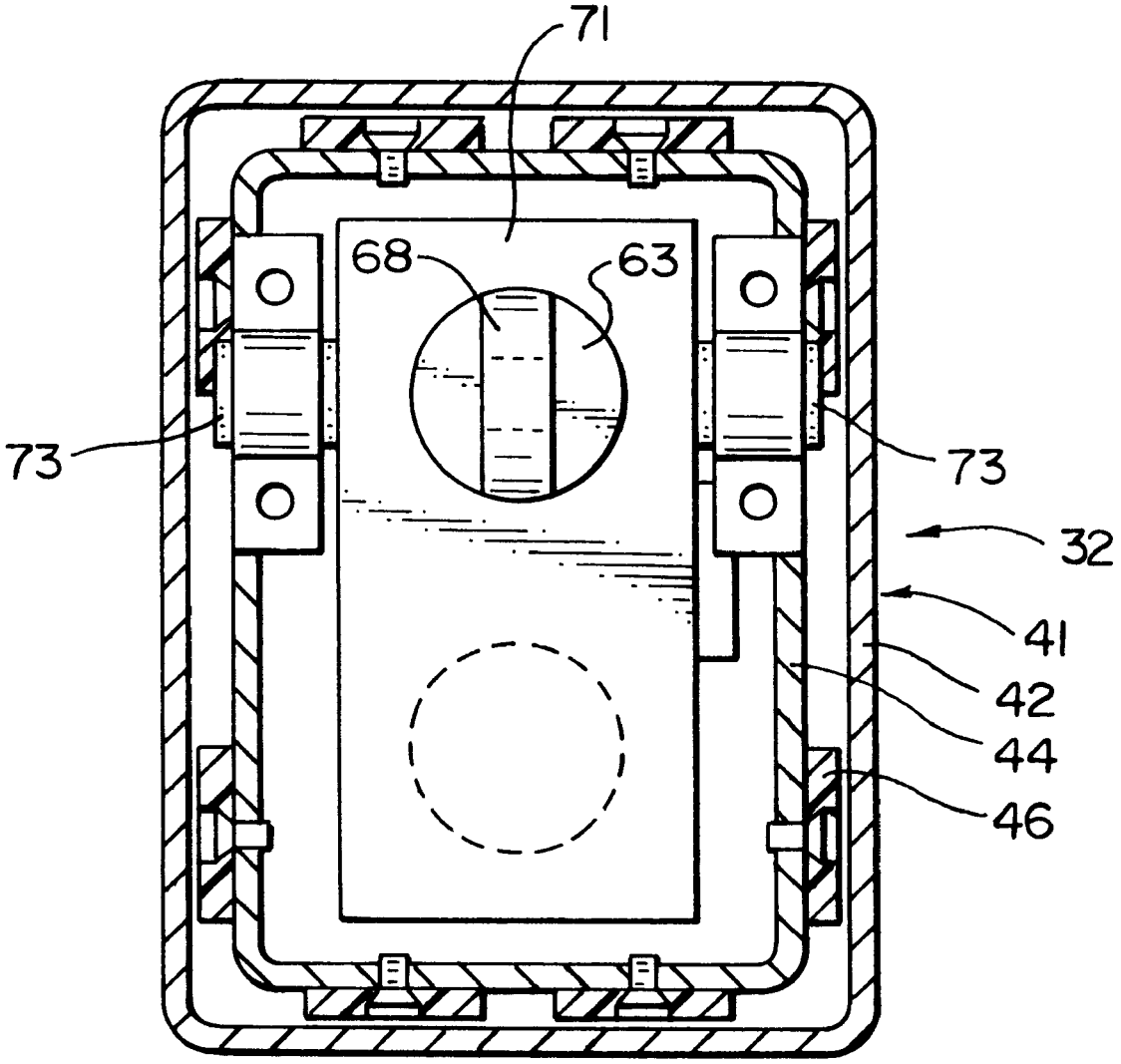
FIG. 8 is a top plan view of the cylinder and piston assembly shown in FIG. 3.

For purposes of description, in FIG. 7 the two piston and cylinder components or units 56 and 58 are shown spaced from one another, so that certain hydraulic lines can be shown more clearly. It is to be understood that this is done only for purposes of illustration, and normally these would be positioned immediately adjacent to one another, as shown in FIGS. 5 and 6.

The piston rod 67 has an outer cylindrical tubular portion 82 and an inner cylindrical tubular portion 84 mounted concentrically in the outer portion 82. The inner tube 84 defines a vertically aligned central passageway 86 and the tubes 82 and 84 define a surrounding annular passageway 88.

There is a first inlet port 90 at the lower end of the rod 67 which connects to the passageway 86. The passageway 86 in turn connects to a passageway 92 in the piston 66 to discharge into the region 96. Thus, when hydraulic fluid is directed into the port 90, the fluid flowing into the region 96 causes the two cylinder members 60 and 64 to move upwardly.

There is also a port 100 in the upper end of the cylinder 64 which leads from the upper chamber or region 96 and extends downwardly through a tubular portion 102 that leads downwardly and then connects at a port 104 leading to a region 106 beneath the piston 62. Thus, at the same time that the fluid entering the port 90 and flowing into the chamber or region 96 to raise both cylinders 60 and 64. The fluid is flowing through the port 104 into the region or chamber 106 to cause the piston 66 to begin moving upwardly within the cylinder 60. Thus, it can be seen that as the hydraulic fluid is directed through the port 90 the two piston rods 62 and 66 are extending out of their cylinders simultaneously.

It should also be noted that while this is described using hydraulic fluid, it would also be possible to make this pneumatic, or also operate under steam pressure.

There is also a fluid inlet port 109 which connects to the aforementioned annular passageway 88. This annular passageway 88 communicates through a port 110 to a chamber or region 112 which is on the opposite side of the piston 94 relative to the chamber or region 96.

Connected to the chamber 112 at a lower location is a port 114 that connects to a transfer tube 116 extending upwardly to lead to a port 118 and into an annular chamber 120 which is, relative to the chamber or region 106 on the opposite side of the piston head 62.

During the operation where there is hydraulic fluid going into the port 90, so that the two pistons 62 and 66 move the rods 63 and 65 to the extended position, fluid is flowing out of the chambers or regions 120 and 112. Thus, as fluid flows into the port 90, fluid is flowing through the port 118 through the tube 116, out the port 114, into the chamber 112 into the port 110 and then down the annular passageway 88 to exit out through the port 109.

From the above description, it can readily be recognized that when the cylinder and piston assembly 32 is being retracted, the entire flow pattern is in the opposite direction. As indicated previously, it is also essential that the lowering of the skirt assembly 18 be accomplished in the manner that the skirt assembly remains substantially horizontal. For this reason, the inflow of fluid into the port 109 and the discharge of the fluid through the port 90 during the lowering process is done in a controlled manner. Normally, the fluid would be pumped into the opening 108 at a predetermined volumetric flow and pressure, and the outlet flow through the port 90 would be further controlled and the flow outwardly through the port 90 would be properly metered.

The diameter of the pistons 62 and 66 are the same and the diameter of the chambers of the cylinders 60 and 64 are the same. Thus, with the volumetric flow rate to each actuator 32 being the same, in this arrangement the rates of the travel of the several actuators are the same.

In order to lock the skirt assembly in its raised position during the transfer of the coke from the chute 10 downwardly through the skirt section 18 and then to the lower chute 14, there is provided a locking apparatus 124. This apparatus comprises a plurality of locking units which are spaced around the perimeter of the body flange 13. For each locking unit 126 there is a related locking finger 128, with each finger being mounted to the upper end of the inner skirt member 20 at circumferential locations corresponding to those of its related units 126.

Each locking unit 126 comprises a mounting member 130 fixedly connected to the body flange 13. Each of these mounting members 130 comprises two vertically aligned and parallel plates 132 spaced from one another and extending radially outwardly from the body flange 13.

The locking unit 126 further comprises a locking arm member 134 which in turn comprises two arm sections 136 spaced from one another laterally and positioned on opposite sides of the mounting plates 132, adjacent to and just outside of the plates 132. The two arm sections 136 of the locking arm 134 are connected to one another at an upper pivotal mounting connection at 138, this mounting connection 138 comprising a cylindrical pin that connects the two arm sections 136. At the opposite end of the locking arm 130 there is an end handle 140 which is a cylindrical member that is fixedly attached to and extends between the outer swing ends of the two arm sections 136.

Each arm section 136 has formed therein a slot 142 which is parallel to a lengthwise axis of its arm sections 136. Positioned within these two slots 142 is a transversely aligned cylindrical locking member 144 which reaches between the two arm sections 136 to extend through the slots 142. At the opposite ends of the locking member 144, there is a collar 145 having a larger diameter than that of the locking member 144 so that it is able to contain the locking member 144 properly positioned within the slots 142 (see FIGS. 10B and 11B). Also, each mounting plate 132 is formed with a slot 146, and the locking member 144 also extends through these two slots 146. Each slot 146 has an outer relatively short, outwardly and downwardly extending slot portion 148 and also an inner downwardly and inwardly extending slot portion 150. When the locking member 144 is in its outward position (shown in broken lines in FIG. 9, it is in its release position. When the locking member 144 is in the full line inward position, as shown in FIG. 9, it is in its locking location.

Reference is now made to FIGS. 10A, 10B, 11A and 11B, which show other details of the locking apparatus 124. More specifically, the two mounting plates 124 and the two arm sections 136 are shown in the Figures, as are the outer locating collars 145 which hold the locking member 144 in place. It also can be seen that the locking finger 128 actually comprises two side sections 152, the upper and outer ends of which are interconnected by a cross member 154.

Figure 9:
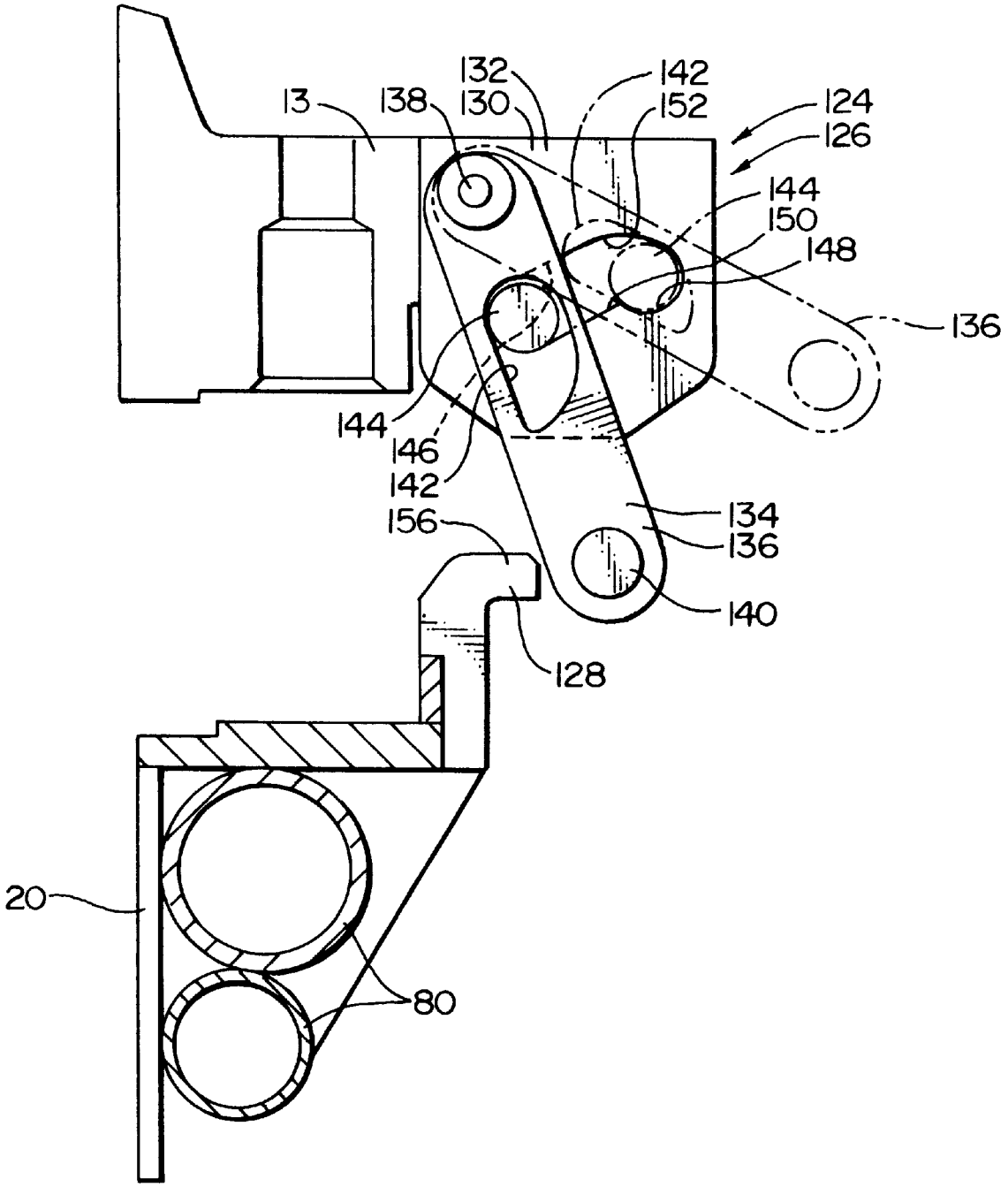
FIG. 9 is a side elevational view of one unit of the locking assembly by which the skirt is maintained in its extended position in contact with the coke drum.
Figure 10B:
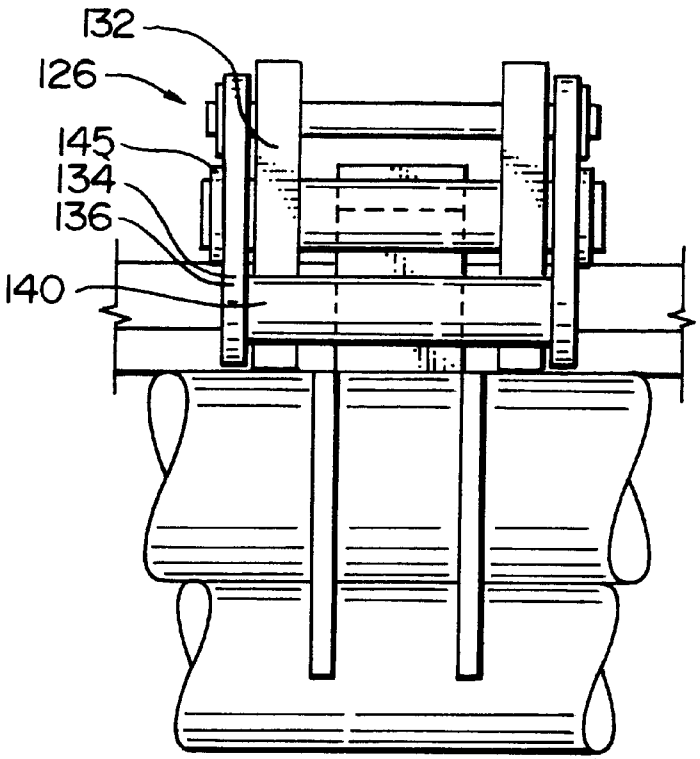
FIG. 10B is a view looking toward the locking unit of FIG. 1, taken from a position offset by 90 degrees.

To describe the operation of the locking apparatus, reference is first made to FIG. 9. The locking arm 134 is shown in solid lines where it is positioned in its down position. In this position, the locking member 144 in its down and inward position in the inner portions 150 of the two slots 146 in the mounting plates 132. Also, the locking member 144 is positioned at the furthest radially inward position of the two arm slots 142. It will be noted that in this position the locking member 144 is above, and vertically aligned with, the locking finger 128.

Figure 11B:
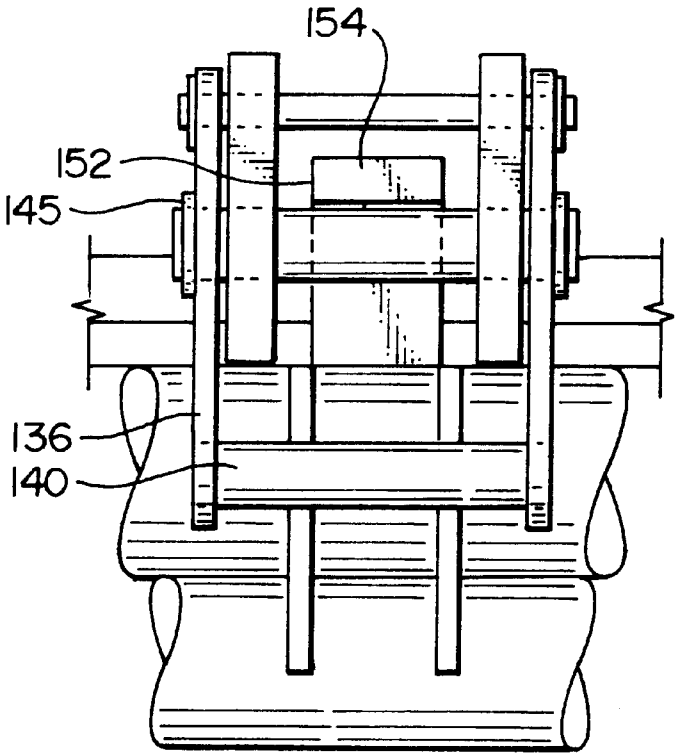
FIG. 11B is a view similar to FIG. 10B, viewing the locking unit in its locking position of FIG. 11A.
Figure 11A:
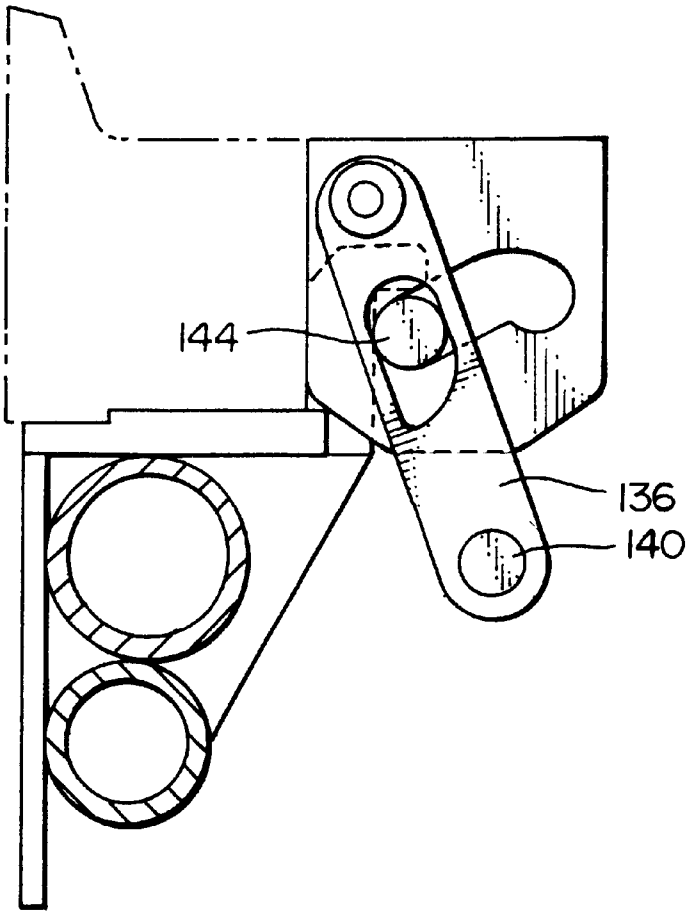
FIG. 11A is a view similar to FIG. 10A, showing the locking unit in its locking position.
Figure 12:
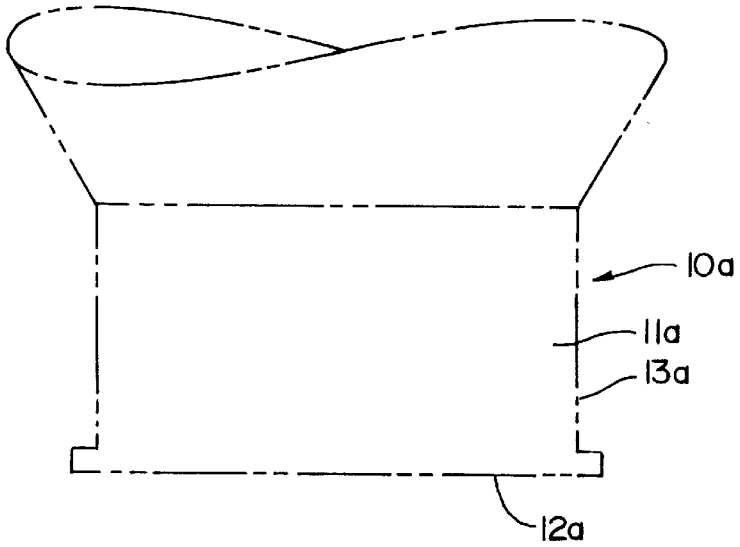
FIG. 12 is view partly in section similar to FIG. 1, showing a second embodiment of the present invention.
Figure 12:
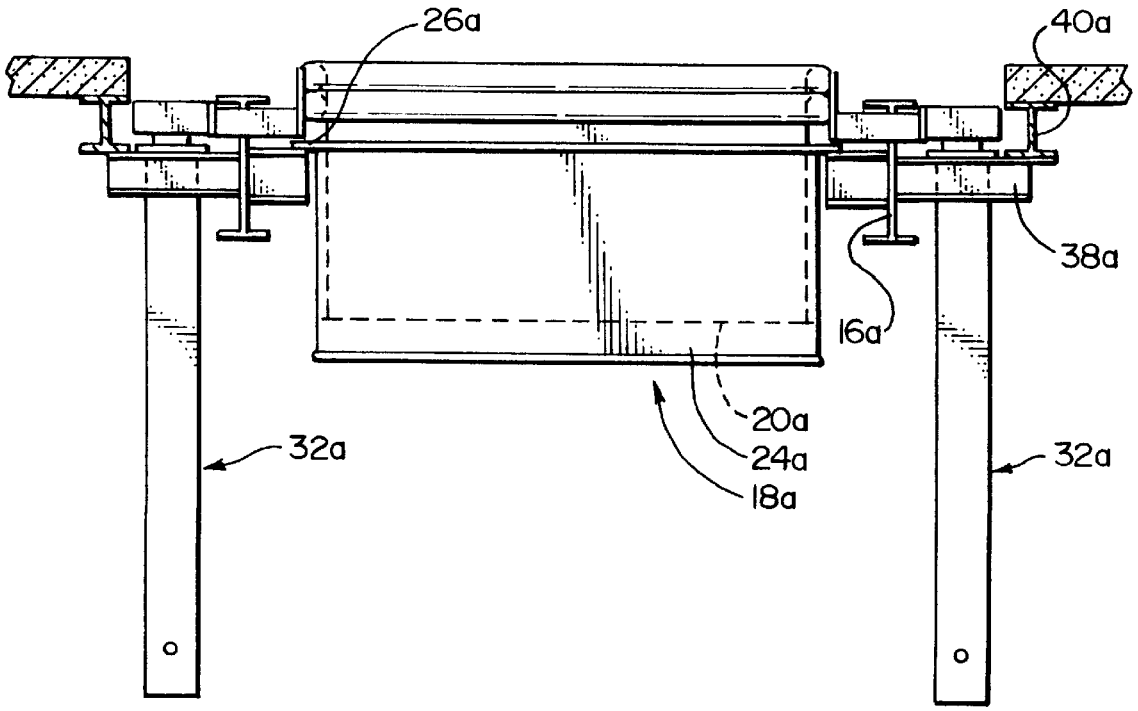
Figure 13:
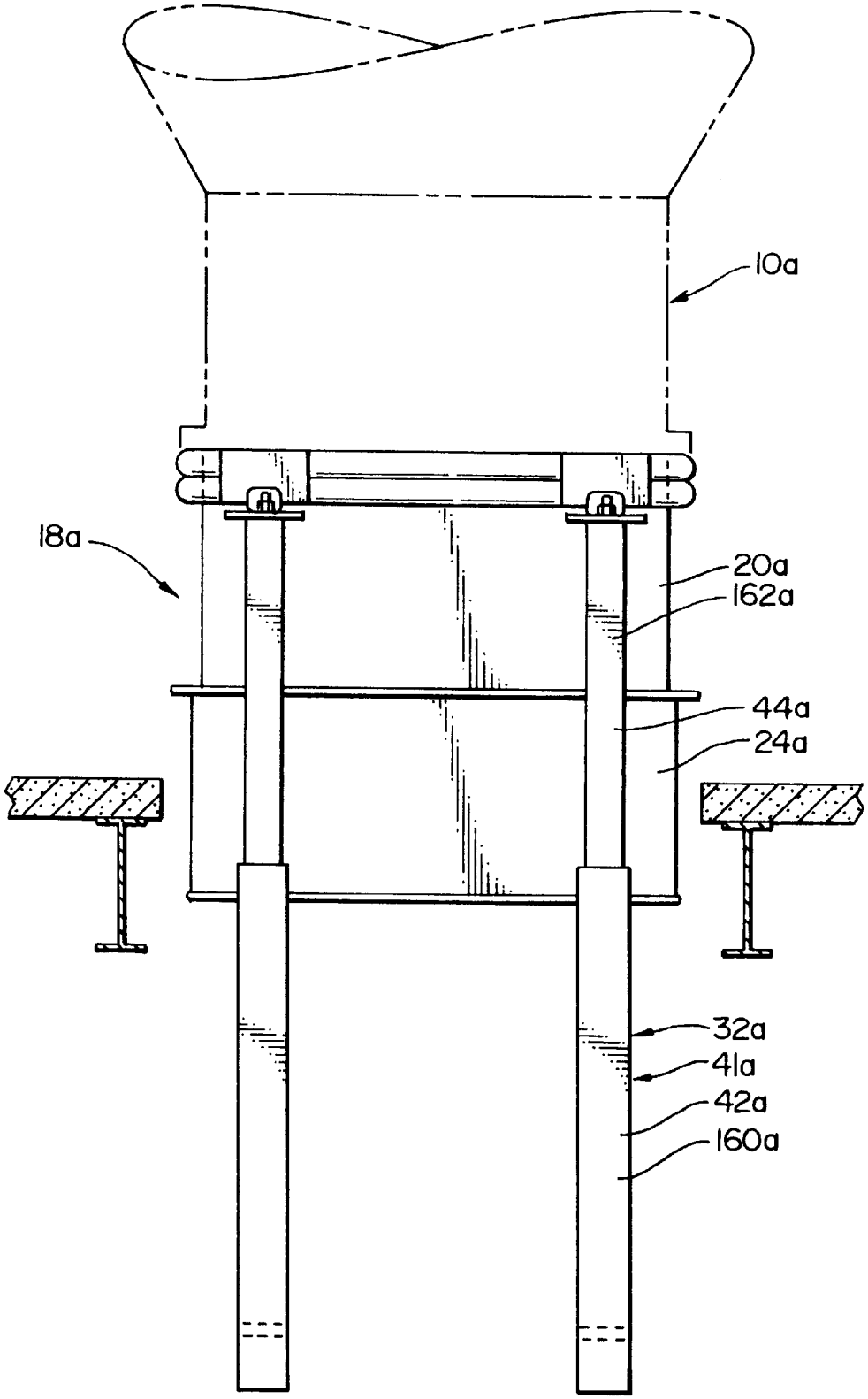
FIG. 13 is a view of the embodiment of FIG. 12, taken from a location removed 90 degrees from FIG. 12, showing the apparatus in its extended system.

With further reference to FIG. 9, as the inner skirt member 20 moves upwardly, the locking finger 128 engages the locking member 144 and pushes it upwardly. This causes the locking member 144 to engage the outwardly and upwardly slanting upper surface of the slot portion 150 so that the locking member 144 moves upwardly and outwardly. When the locking member 144 reaches a peak location at 152 of the slot 146, the locking finger 128 passes upwardly by the locking member 144. After the locking finger 128 moves upwardly far enough to clear the locking member 144, the force of gravity causes the locking arm 134 to drop downwardly toward its solid line position of FIG. 9, and the locking member 144 also drops downwardly into the solid line position of FIG. 9. Then the hydraulic pressure of the fluid that is causing the cylinder and piston assembly 32 to extend can be reduced, and the upper skirt portion 20 will move downwardly just slightly so that outwardly extending portion 156 of the finger 128 rests on the locking member 144. This is the locking position which is shown in FIGS. 11A and 11B.

Figure 10A:
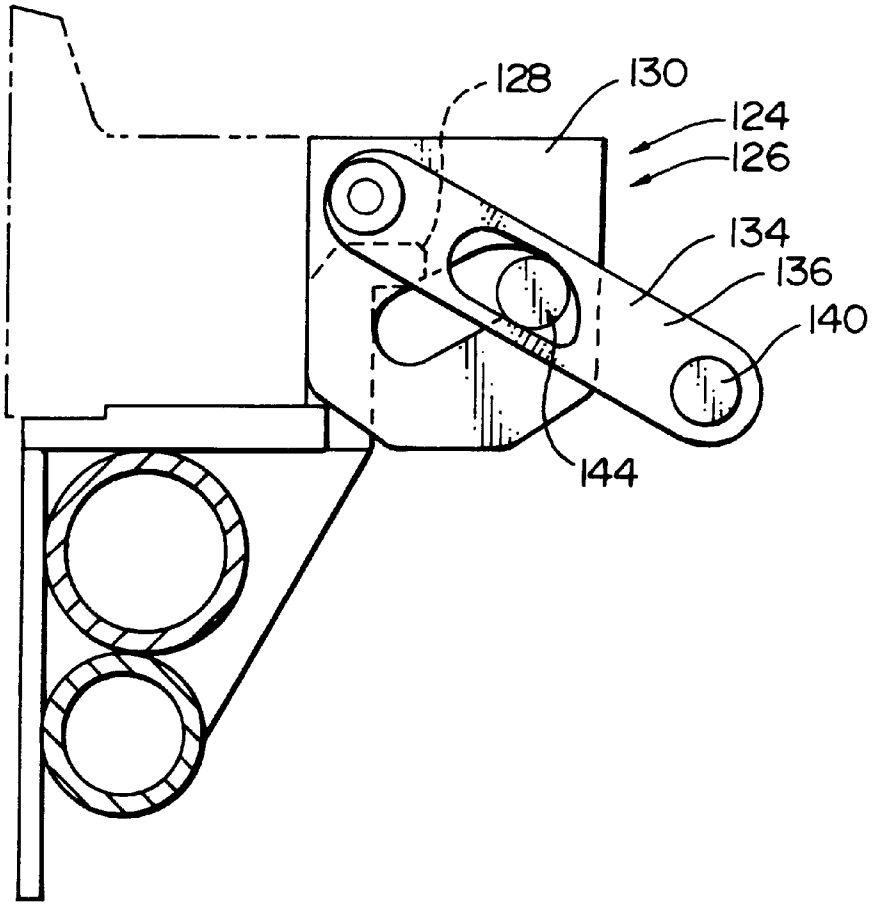
FIG. 10A is a view similar to FIG. 9, but showing the locking unit in its release position.

To move the locking unit 126 to its release position, the cylinder and piston assemblies 32 are pressurized to cause them to raise upwardly a very short distance so as to release the locking member 144. Then the handle 140 of the locking arm 134 is manually pulled upwardly and outwardly to the release position which is shown in FIG. 10A. This raises the locking member 144 back up toward the peak location 152, and the locking member 144 then drops into the outer slot portions 148 to move to the dotted line position in FIG. 9.

It can be seen that in this location after the handle 140 is released, and the locking arm 134 drops downwardly a short distance, the locking member 144 is held in its out position and the locking arm 134 remains in its outer release position as shown in FIG. 10A. In this position, the skirt assembly 18 can be lowered to its retracted position. At a later time, to return the locking arm to its pre-locking position of FIG. 9, the person grasps the handle 140, pulls it upwardly and at the same time pushes the locking member 144 inwardly toward the coke drum. This causes the locking member 144 to travel inwardly along the slots 146 in the plates 142, and then with the handle being released, the locking arm 134 will drop and the locking member 144 will move downwardly in the inner slot portions 150 and return to the position shown in full lines in FIG. 9. In this position, the locking unit 126 is ready to be again engaged by the locking finger 138 during the next cycle of operation of the apparatus.

To review the overall operation of the present invention, let us assume that the coking operation is taking place and the skirt assembly 18 is in its retracted position in FIG. 1. In the particular installation shown herein, at the completion of the coking process the lower cover that closes the body flange 12 needs to be removed. One method of doing this is to move a carriage underneath the drum 10 on rails, and the large heavy cover is then lowered onto the carriage and the carriage takes it away. Another method would be to swing the cover hydraulically. After the cover has been removed, then the skirt assembly 18 is raised in the manner described above by directing the fluid into the inlet port 90 of the several piston and cylinder assemblies 32. The upper end of the innermost skirt component 20 at the position of FIG. 2 fits against the lower circumferential edge portion 30 of the body flange 12. The locking apparatus 124 functions to lock the raised upper skirt 20 in place. When this is accomplished, then the coke in the drum 10 can be discharged by means of multiple high-powered water jets to fall into the chute 14.

After the discharge of the coke is completed, the locking units 126 are moved to their release positions. Then to accomplish a retraction of the skirt component 18, the fluid is directed through the port 109 to cause the piston and cylinder assemblies 32 to retract in a controlled manner.

Another feature of the present invention is the manner in which the lateral and/or torsional loads are reacted in the structure. The two cylinders 60 and 64 are fixedly mounted within the extension tube 44. Thus, any bending moments imposed upon the cylinders 60 and 64 will be reacted into the extension tube 44 and into the fixed tube 42. In like manner, any torsional loads caused by forces exerted to rotate the extension tube 44 about its longitudinal axis would be resisted in the same manner.

Also, as can be seen from viewing FIG. 4, the extended cylinder assemblies 32 are such that the bending moments and also the torsional moments would be largely resisted by the interaction of these tubes 42 and 44.

Also, a particular advantage of this arrangement of having these siamese piston and cylinder assemblies is that in some installations, the clearance around the perimeter of the inlet end of the chute is rather restricted with regard to its vertical dimension. Thus, as can be seen in FIG. 1, the entire piston and cylinder assemblies 32 are in their retracted positions in a vertical space which is almost one half the space between the body flange 12 and the base structure at 40. This leaves greater clearance for operating in the area between the body flange 12 and the floor structure 40.

A second embodiment of the present invention is shown in FIGS. 12 through 17. Components of this second embodiment which are similar to those of the first embodiment will be given like numerical designations, with an "a" suffix distinguishing those of the second embodiment.

This second embodiment differs from the first embodiment mainly in two ways. First, there are only two skirt sections instead of three. Also, each cylinder and piston assembly 32*a* of this second embodiment comprises only a single cylinder and single piston for each assembly.

The coke chute 10*a* is substantially the same (or identical to) the coke chute 10 of the first embodiment and comprises the discharge portion 11*a,* having an end opening 12*a* and also the body flange 13*a*. As indicated above, the skirt assembly 18*a* differs from the skirt assembly 18 in that there are only two skirt components 20*a* and 24*a*. The inner skirt component 20*a* moves in substantially the same manner as in the first embodiment, and the upper edge portion thereof engages the body flange 13*a* during the discharge of the coke.

There is a plurality of actuators 32*a*, but instead of having the Siamese piston arrangement of the first embodiment, there is only a single cylinder 160*a*, a single piston rod 162*a*, and also a single piston 164*a*.

Figure 14:
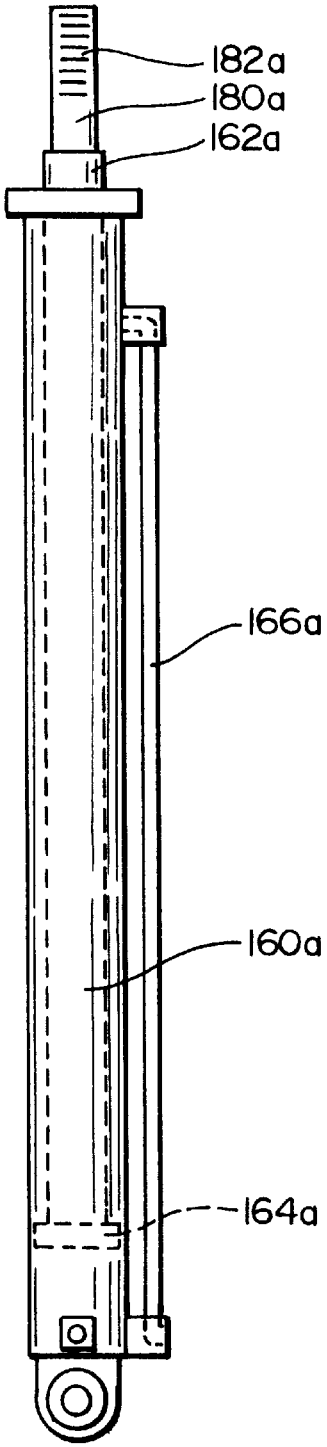
FIG. 14 is a side elevational view of the cylinder and piston component of one of the actuators of the second embodiment.
Figure 17:
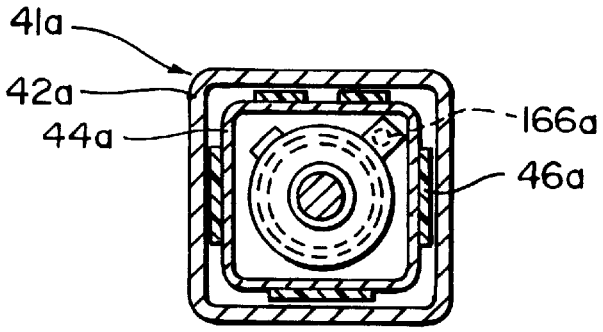
FIG. 17 is a sectional view taken along line 17—17 of FIG. 15.

The tube assembly 41 a in the second embodiment is similar to the tube assembly 41 of the first embodiment, except that in the present embodiment the inner extendible tube 44*a* and the outer fixed tube 42*a* have a square cross sectional configuration, since there is only the single cylinder and piston assembly. Also, as can be seen in FIGS. 14, 15 and 17, there a hydraulic line 166*a* which is positioned within the tube assembly 41*a,* and extends along side of the cylinder 160*a*.

Figure 15:
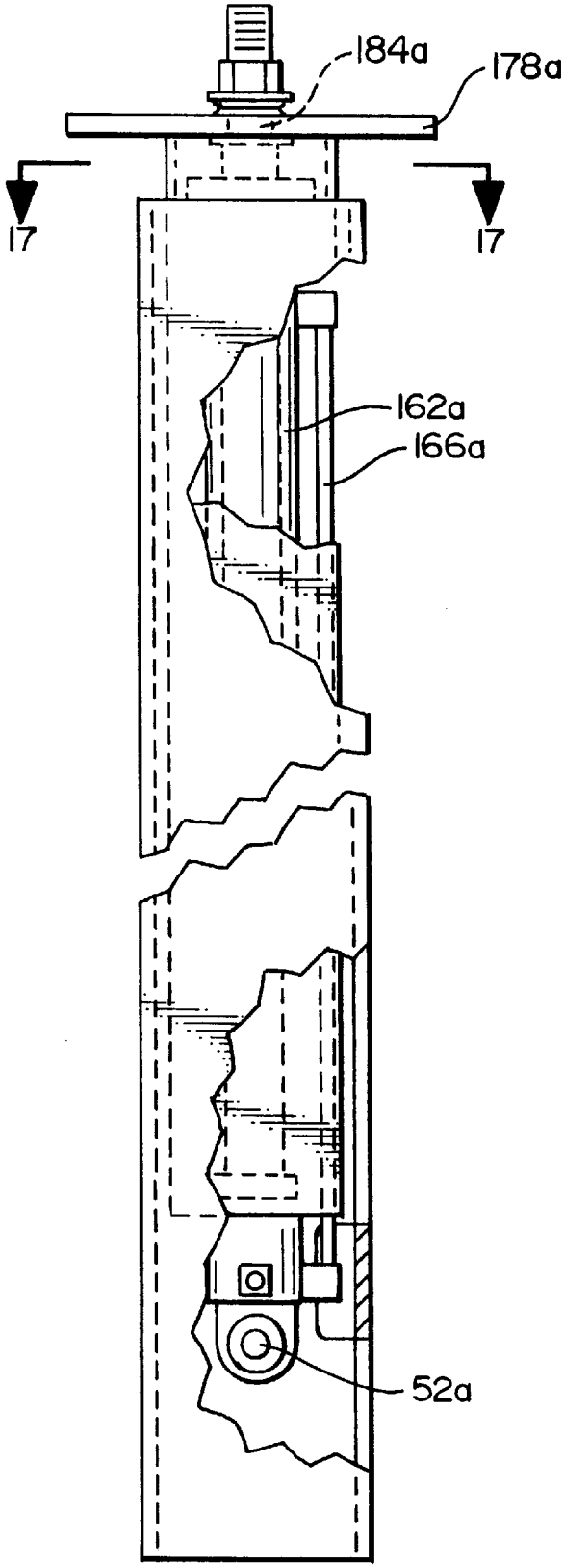
FIG. 15 is a side elevational view of one of the actuators of he second embodiment.
Figure 16:
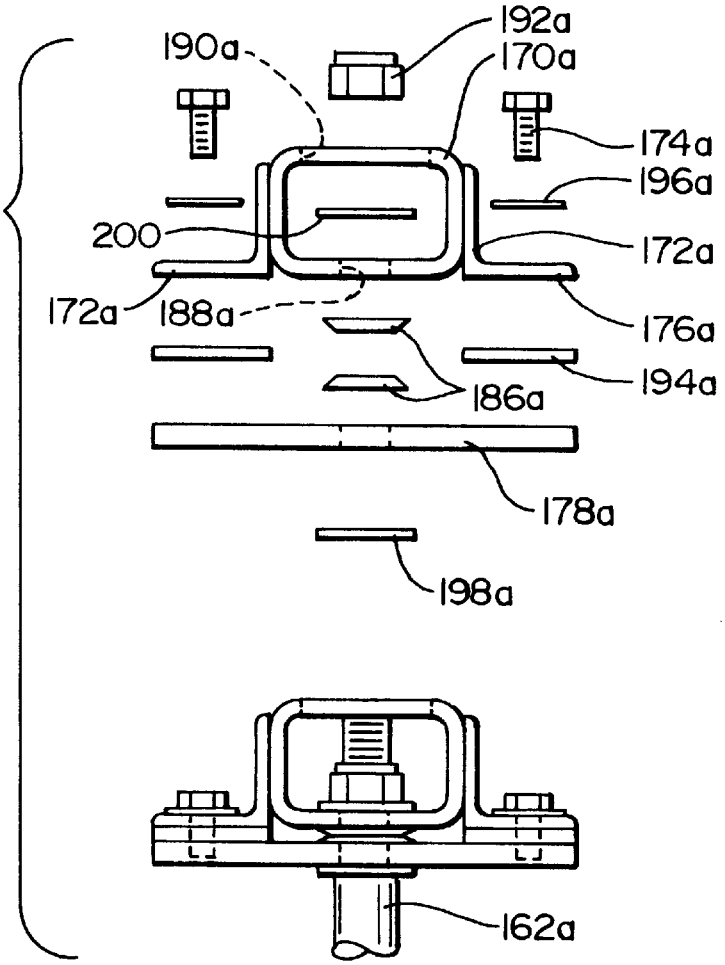
FIG. 16 is an exploded view showing the components at the upper end of the actuator of FIG. 15.

The upper connection of the piston rod 162*a* through the upper skirt 20*a* is somewhat different than in the first embodiment, and the arrangement of the present embodiment is best shown in FIGS. 15 and 16. There is a main box like support member 170*a*, and this is in turn fixedly connected to two angle irons 172*a* on opposite sides thereof. A plurality of bolts 174*a* are inserted through openings in flanges 176*a* of the right angle members 172*a* and thread into a mounting plate 178*a*. The plate 178*a* is fixedly connected to the upper edge of the inner extendible tube 44*a*.

The piston rod 162*a* has an upstanding attaching member 180*a*, the upper end of which is threaded at 182*a*. This threaded member 182*a* extends upwardly through a center opening 184*a* in the plate 178*a,* and upwardly through a pair of spacing elements 186*a,* and through a bottom opening 188*a* in the box like member 170*a*. The box like member has an upper opening 190*a* so that a nut 192*a* can be threaded onto the upper threaded member 182*a*. Also, washers at 194*a* and 196*a* can be provided to be positioned on opposite sides of the flanges 176*a*. A bottom washer 198*a* is positioned between the plate 178*a* and the upper stepped surface portion of the piston rod 162*a*, and an upper washer 200*a* is provided.

The arrangement of this upper fastening portion of each of the cylinder and piston assemblies 32*a* insures that any loads that are imposed on the cylinder and piston assemblies 32*a* are transferred directly into the upper tubular portion 44*a* and into the lower tubular portions 42*a*. Thus, as explained previously herein, this isolates the various lateral and torsion loads that would otherwise be imposed on the cylinder and piston units 160*a*.

It is believed that the operation of the second embodiment can be readily understood by reading the mode of operation of the first embodiment. Accordingly, this will not be described in detail herein.

It is to be recognized that various modifications could be made in the present invention without departing from the basic teachings thereof.

What is claimed is:

1. An apparatus to direct coke from an outlet of a coking drum to a receiving location, said apparatus comprising:

a. a skirt section which has an upper inlet end which is movable from a lower retracted position to an upper engaged position to receive the coke from the coking drum;

b. a plurality of fluid actuators arranged to be in operative arrangement with the skirt to move the skirt between its retracted and engaged positions;

c. each of said actuators comprising first and second cylinder and piston units, having first and second cylinders, respectively, and first and second piston members, respectively, each piston member comprising a piston and a piston rod, said first and second cylinders being positioned in side by side relationship and arranged so that the piston rod of the first piston member extends in a downward direction from said first cylinder, and the piston rod of said second piston member extends upwardly from said second cylinder;

d. a lower end of the piston rod of the first piston member being connected to a lower base location, and an upper end of the piston rod of the second piston member being connected to said skirt section, whereby when each of the fluid actuators are extended, an extension of the first piston member from the first cylinder causes the first and second cylinder members to move upwardly, and an extension of the second piston member from the second cylinder moves the upper end of the piston rod of the second piston member upwardly to move the skirt upwardly toward its upper engaged position.

2. The apparatus as recited in claim 1, wherein there is a first fluid inlet/outlet at the lower end of the piston rod of the first piston member and a passageway in the first piston rod leading from the first fluid inlet/outlet to a pressure region in an upper part of the first cylinder above the first piston so that fluid from the first inlet/outlet travels upwardly through the passageway of the first piston rod to cause upward movement of the first and second cylinders.

3. The apparatus as recited in claim 2 wherein there is a first fluid inlet/outlet at the upper pressure region of the first cylinder, leading to a second pressure region at a lower part of the second cylinder and below the second piston in the second cylinder, so that fluid flow through the first inlet/outlet causes fluid to flow upwardly through the passageway in the piston rod of the first piston member into the first piston pressure region, and thence into the second pressure region of the second cylinder so as to cause both of said first and second piston members to extend.

4. The apparatus as recited in claim 3, wherein there is a second fluid inlet/outlet at a lower end of the piston rod of the first piston member through which fluid flows from said piston rod of the first piston member during extension of the first piston member, said piston rod of the first piston member having a fluid outflow passageway having an upper opening at an upper end of the first piston member to receive an outflow of fluid from an annular region between the piston rod of the first piston member and the first cylinder.

5. The apparatus as recited in claim 4, wherein there is a third fluid inlet/outlet at the lower end of the first cylinder which communicates with the annular region between the first cylinder and the piston rod of the first position member to receive fluid flow from an annular region that is between the piston rod of the second piston member and the second cylinder, so that when the first and second pistons are moving toward an extended position, fluid flow from the annular region within the second cylinder flows to the annular region of the first cylinder, thence into the upper opening to the second passageway in the piston rod of the first piston member to flow outwardly through the inlet/outlet leading from the lower end of the first piston member.

6. The apparatus as recited in claim 5, wherein the first passageway in the piston rod of the first piston member comprises a tubular member positioned within said piston rod of the first piston member, and said second return passageway in said piston rod of the first piston member comprises an annular passageway defined by a surrounding tubular wall of the piston rod of the first piston member and the tubular member that defines the first passageway in the first piston member.

7. The apparatus as recited in claim 1, wherein there is for each fluid actuator a telescoping load bearing structure comprising at least first and second load bearing sections located at least partially around said first and second cylinder and piston units, the first and second load bearing sections having a retracted position when the first and second cylinder and piston units are in a retracted position, and an extended position when the first and second cylinder and piston units are in the extended position, said first load bearing section engaging a base location so as to be able to transfer loads from said first bearing structure section to said base location, and said second load bearing section operably engaging said first and second cylinder and piston units in a manner to receive torsional and/or lateral loads and transmit these to the first load bearing section to alleviate such lateral and/or torsional loads being imposed solely on said first and second cylinder and piston units.

8. The apparatus as recited in claim 7, wherein said second load bearing section has an upper end thereof connected to an upper end of the first and second cylinders, and the lower end of the first load bearing member extends downward to a location at which the first end of the piston rod of the first Piston member is located.

9. The apparatus as recited in claim 8, wherein said first and second load bearing sections have non circular cross sectional configurations, to prevent rotational movement relative to one another along a lengthwise axis, and in the retracted position, the first and second load bearing sections are telescopically retracted, so as to surround the first and second cylinders, and as said first and second cylinder and piston units extend, the second load bearing section moves upwardly with the first and second cylinders, and the first load bearing section remains positioned around the lower end of the piston rod of the first piston member.

10. The apparatus as recited in claim 1, wherein there is a locking system comprising;

a. at least one locking unit being mounted at a location proximate to an upper portion of said skirt when said skirt is in its upper engaged position;

b. a locking element connected to said skirt, and being operable to move into a locking location when the skirt is in its upper engaged position;

c. said locking unit comprising a locking arm having a pivot location about which it rotates and an outer end location, said locking arm having a locking member which in a locking position engages the locking element and in a release position is spaced laterally from the locking element, said locking element being arranged so that as the skirt moves upwardly toward its engaged position, and said locking arm is at its lower locking location, said upward movement of said locking element causes movement of said locking arm away from its locking position, and further upward movement of said locking element permits downward movement of said locking arm to its locking position, with said locking member positioned in locking engagement with said locking element.

11. The apparatus as recited in claim 10, wherein the locking element is mounted to the locking arm in a manner that the locking element is moveable toward and away from the pivot mounting location of the locking arm, said locking member being arranged so that in movement from its locking position toward its release position, the locking member moves to a hold release position to prevent said locking arm from moving to its locking position.

12. The apparatus as recited in claim 10, wherein said locking arm comprises a pair of arm elements having elongate slots therein, and said locking member is moveable back and forth within said slots, and said locking unit comprises a mounting structure having a locating edge portion which engages the locking member as the locking arm is being moved from the locking to the release position, so as to move the locking member to its hold release position.

13. The apparatus as recited in claim 10, wherein said mounting structure comprises a pair of mounting plates, each of which is located adjacent to a related one of the pair of arm elements, the locating edge portion of the mounting structure comprising a locating slot in each of the mounting plates, the elongate slots of the arm elements and the slots of the mounting plates co-acting to program movement of the blocking member into and from its locking position and into and from its hold release position.

14. The apparatus as recited in claim 1, wherein said skirt section comprises a plurality of skirt members telescopically mounted relative to one another.

15. The apparatus as recited in claim 14, where there is at least three skirt members to said skirt section.

* * * * *